United States Patent [19]

Cobaugh et al.

[11] Patent Number: 4,586,772

[45] Date of Patent: May 6, 1986

[54] IMPROVED CARD EDGE CONNECTOR

[75] Inventors: Robert F. Cobaugh, Elizabethtown; James L. Fedder, Harrisburg; Attalee S. Taylor, Palmyra, all of Pa.

[73] Assignee: AMP Incorporated, Harrisburg, Pa.

[21] Appl. No.: 646,721

[22] Filed: Sep. 4, 1984

Related U.S. Application Data

[63] Continuation of Ser. No. 503,995, Jun. 13, 1983, abandoned.

[51] Int. Cl.[4] ..... H01R 9/09

[52] U.S. Cl. ..... 339/75 MP; 339/176 MP

[58] Field of Search ..... 339/75 MP, 176 MP

[56] References Cited

U.S. PATENT DOCUMENTS

| | | | |
|---|---|---|---|
| 3,585,573 | 6/1971 | Robshaw | 339/176 MP |
| 3,868,166 | 2/1975 | Ammon | 339/176 MP |
| 3,982,807 | 9/1976 | Anhalt et al. | 339/75 MP |
| 4,050,758 | 9/1977 | Curley | 339/74 R |
| 4,168,879 | 9/1979 | Ohtsuki et al. | 339/176 MP |
| 4,262,981 | 4/1981 | Goodman | 339/176 MP |
| 4,357,066 | 11/1982 | Cairns et al. | 339/259 R |
| 4,480,884 | 11/1984 | Babuka et al. | 339/75 MP |

OTHER PUBLICATIONS

IBM Technical Disclosure Bulletin, vol. 14, No. 9, 2/1972, Colletti et al., "Twin-Contact Connector".

*Primary Examiner*—John McQuade

*Attorney, Agent, or Firm*—Allan B. Osborne

[57] ABSTRACT

The present invention discloses a contact element for use in card edge connectors on which the contact surface is located at the free end of the cantilever beam and includes a sharp spherical radius.

4 Claims, 7 Drawing Figures

IMPROVED CARD EDGE CONNECTOR

This is a continuation of application Ser. No. 503,995, filed June 13, 1983, now abandoned.

Card edge connectors typically contain contact elements having a pin or lead extending downwardly through the connector for insertion into a printed circuit board and a cantilever beam extending upwardly alongside the card-receiving slot. A convex contact surface, located on the beam inwardly from the free end thereof, engages the conductive traces on the printed circuit card. The convex surface provides a relatively large metal to the metal mating area for good wiping action as the beam engages the card and for good electrical contact therewith. U.S. Pat. Nos. 3,665,370, 3,671,917, 4,077,688, and 4,303,294 each disclose contact elements which have different overall cantilever beam structures but with the aforementioned convex contact surfaces.

The present invention is intended to provide a contact element of the above kind but with a conceptually and structurally different contact surface which more readily and reliably wipes through oxides and debris on the conductive traces on the circuit card.

A contact element as defined in the first paragraph of this specification is, according to the present invention therefore, characterized in that the contact surface is located at the free end of the cantilever beam and is formed to provide a sharp spherical radius which, in wiping across the conductive trace, breaks through debris and oxides more readily and reliably. Further, the length of the beam can be reduced to provide a lower height.

For a better understanding of the invention, reference will now be made by way of example to the accompanying drawings, in which.

Figure 1:
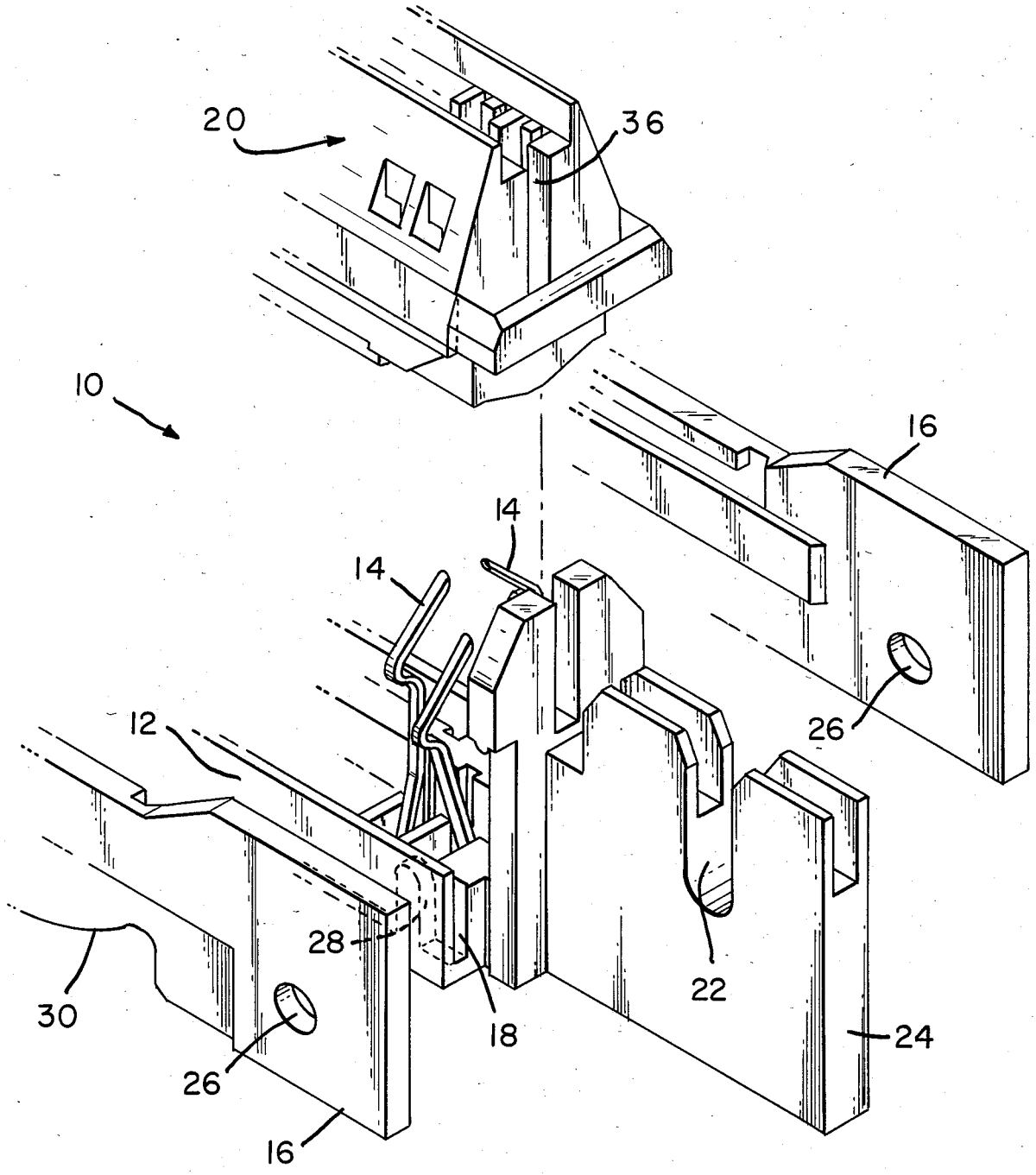
FIG. 1 is an exploded, isometric view of a ZIF card edge connector containing the contact elements of the present invention.
Figure 2:
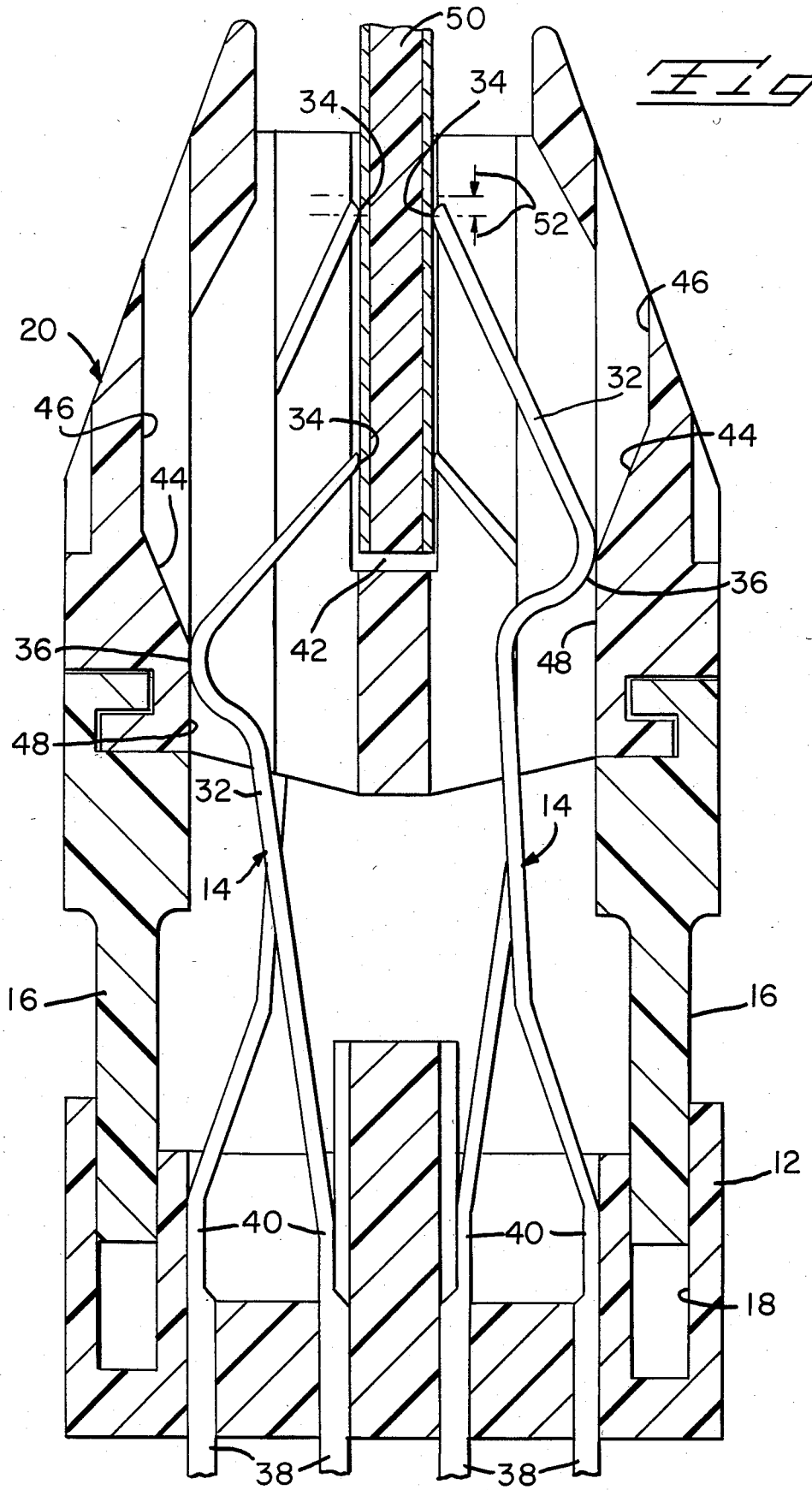
FIG. 2 is a cross-sectional, end view of an assembled ZIF card edge connector showing the contact elements of the present invention in engagement with a printed circuit card.
Figure 3:
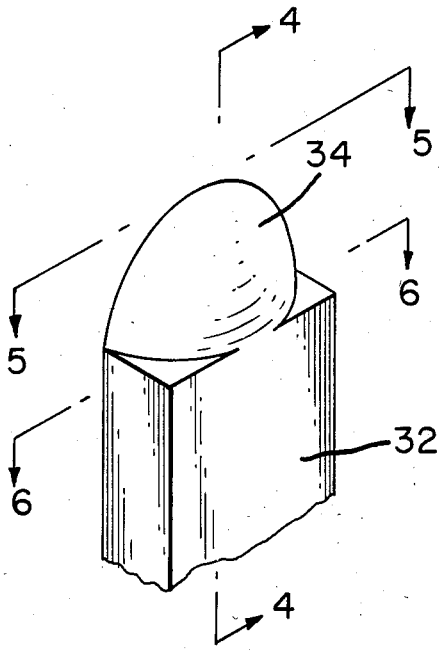
FIG. 3 is an enlarged, isometric view of the contact surface on the contact element of the present invention.

ZIF card edge connector 10, shown in FIGS. 1 and 2, includes lower housing 12, contact elements 14, a pair of cam members 16 which are movably positioned in grooves 18 on lower housing 12 and upper housing 20. Lever means (not shown) cooperating between slot 22 in projection 24 and holes 26 in cam members 16 move those members longitudinally. Cams 28 in the grooves cooperate with ramps 30 on the cam members to move those members vertically as they move longitudinally. Upper housing 20, riding on the cam members, moves up or down as the members are pulled outwardly or pushed inwardly by the lever means.

With reference to FIG. 2, the upper portion of contact elements 14 is a cantilever beam indicated by reference numeral 32. The free end; i.e., the extreme end or tip, of the beam carries contact surface 34. A convex cam surface 36 is located inwardly from the free end.

The lower portion of the contact element is a lead 38 which is positioned in a plated-through hole in a printed circuit board (not shown).

Retaining means, indicated by reference numeral 40, located between and joining the lead and cantilever beam, hold the contact element in the lower housing.

As shown in FIG. 2, cantilever beams 32 extend upwardly into upper housing 20 and are located on either side of a card-receiving slot 42. These beams are preloaded so that cam surfaces 36 bear against the inside walls of the housing. These walls include a slanted portion 44 with vertical portions 46 and 48 above and below respectively. With the upper housing in a down position (not shown), the cantilever beams bear against vertical wall portion 46 and the contact surfaces 34 at the free ends of the beams are removed from card slot 42. Card 50 may be freely inserted or withdrawn from the slot without interference from the contact surfaces 34.

As cam members 16 are pulled along grooves 18, they move vertically upwardly, moving upper housing 20 in the same direction. The slanted wall portions 44, engaging cam surfaces 36 on the cantilever beams, force the beams inwardly and more particularly, the contact surfaces 34. The contact surfaces, moving into card slot 42, contact conductive traces on card 50 which may be inserted therein. Further, as the beams are forced inwardly, they straighten up. This causes the contact surfaces to slide up on the traces on the card to wipe away debris, dirt and other contaminants which may be present. Back wipe also occurs by reason of the cam 28 and ramp 30 structure and accordingly, the traces are wiped in a downward direction also. The approximate amount of wipe is indicated by the space bracketed by the two arrows 52.

Figure 4:
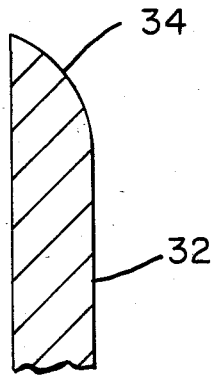
FIG. 4 is a side cross-sectional view of the contact surface of FIG. 3 taken along line 4—4 therein.
Figure 5:
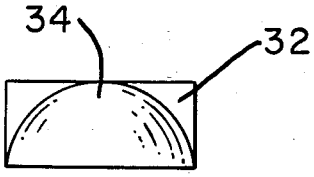
FIG. 5 is an end view taken along line 5—5 looking down onto the contact surface of FIG. 3.
Figure 6:
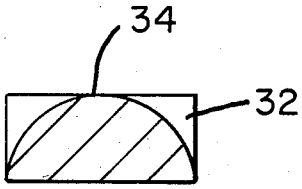
FIG. 6 is a cross-sectional view taken along line 6—6 in FIG. 3.

Contact surface 34 is shown greatly enlarged in FIGS. 3 through 6. The surface is spherical with a radius ranging from about 0.008 to about 0.016 inches (0.203 to 0.406 mm) and as noted above, is located at the free end of cantilever beam 32. Preferably, the spherical surface describes a 0.012 inch (0.305 mm) radius. FIGS. 4, 5, and 6 are views taken at different points to illustrate the spherical shape.

Figure 7:
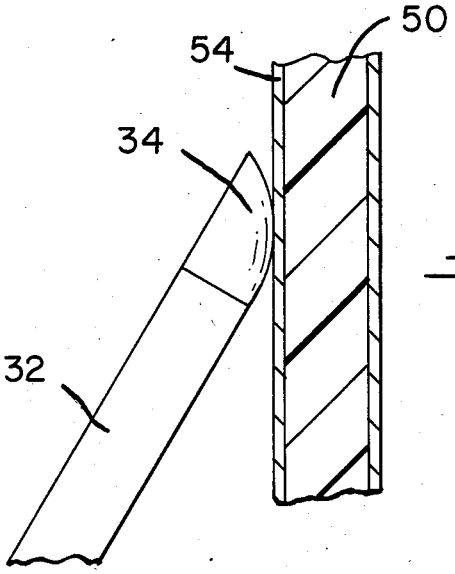
FIG. 7 is a cross-sectional view of the contact surface engaging a conductive trace on a printed circuit card.

FIG. 7 is an enlarged view showing the angle of contact surface 34 in engaging conductive trace 54 on card 50.

Of the several advantages of the present invention, one of the most important concerns the ability of the contact surface to bear against and wipe the conductive trace surface. Tests have demonstrated that the "point"-type contact surface cuts or wipes through debris more positively than conventional contact surfaces which typically have an engaging radius of about 0.025 to 0.040 inches (0.635 to 1.016 mm). This ability results from the pressure being exerted on the trace is more concentrated through the smaller radius on the contact surface 34.

Another important advantage of the present invention is that the overall height of the cantilever beam may be significantly reduced without loss of spring characteristics nor in the ability to preload the beam in the housing.

Yet another advantage discovered is that a small area need be plated with noble metals; e.g., gold. Accordingly, a significant cost savings is available.

The method of forming contact surface 34 is preferably by coining.

We claim:

1. A zero insertion force, card edge connector, comprising:

a. a lower housing with a base having a plurality of passages located along each longitudinal side;

b. an upper housing positioned over the lower housing with means therebetween for vertically moving the upper housing relative to the lower housing, said upper housing having sidewalls with a longitudinally extending card receiving slot therebetween and transversely extending slanted wall portions spaced along the inside surfaces of the sidewalls and facing the slot; and c. a plurality of contact elements having either a short or a long cantilever beam on which is a convex surface and, at the extreme free end, a spherical contact surface, said contact elements being positioned in the passages in the base of the lower housing with the cantilever beams extending into the upper housing with the spherical contact surfaces pointing towards the slot and with the convex surfaces engageable by the slanted wall portions so that as the upper housing moves up the spherical contact surfaces are cammed into the slot to engage traces on a circuit card which may be therein, said contact elements being placed such that a long beam is adjacent a short beam along each side of the slot and further a long beam on one side of the slot faces a short beam on the other side so that if the spherical contact surfaces are cammed into the slot without a circuit card therein, the facing spherical contact surfaces will be vertically displaced one from the other and will not touch.

2. The connector of claim 1 wherein continued upward travel of the upper housing after the spherical contact surface engages the trace causes the cantilever beam to resiliently straighten upwardly such that the spherical contact surface moves on the trace to wipe debris and the like therefrom.

3. The connector of claim 1 wherein the radius of the spherical contact surface is from about 0.008 inches (0.203 mm) about 0.016 inches (0.406 mm).

4. The connector of claim 3 wherein the radius of the spherical contact surface is about 0.012 inches (0.305 mm).

* * * * *